US008556077B1

(12) United States Patent
Hanley

(10) Patent No.: US 8,556,077 B1
(45) Date of Patent: Oct. 15, 2013

(54) MEDICATION DISPENSING BLISTER CARD PACKAGE WITH ADJUSTABLE MECHANISM THAT PROVIDES A CUSTOM PATIENT SCHEDULE FOR COMPLEX MEDICATION REGIMENS

(76) Inventor: Michael Hanley, Brookline, MA (US)

( * ) Notice: Subject to any disclaimer, the term of this patent is extended or adjusted under 35 U.S.C. 154(b) by 0 days.

(21) Appl. No.: 13/451,186

(22) Filed: Apr. 19, 2012

(51) Int. Cl.
*B65D 83/04* (2006.01)

(52) U.S. Cl.
USPC ..... 206/534; 206/531; 604/403

(58) Field of Classification Search
USPC ..... 206/531–539; 604/403–408
See application file for complete search history.

(56) References Cited

U.S. PATENT DOCUMENTS

| | | | | |
|---|---|---|---|---|
| 332,208 | A | 12/1885 | Noel | |
| 3,533,371 | A * | 10/1970 | Gronemeyer et al. | 206/534 |
| 4,295,567 | A | 10/1981 | Knudsen | |
| 4,646,936 | A | 3/1987 | Frazier et al. | |
| 4,660,991 | A | 4/1987 | Simon | |
| 4,736,849 | A | 4/1988 | Leonard et al. | |
| 4,889,236 | A * | 12/1989 | Bartell et al. | 206/531 |
| 4,915,256 | A | 4/1990 | Tump | |
| 5,570,810 | A | 11/1996 | Lambelet et al. | |
| 5,752,235 | A | 5/1998 | Kehr et al. | |
| 6,411,567 | B1 | 6/2002 | Niemiec et al. | |
| 7,017,513 | B2 | 3/2006 | Giewercer | |
| 7,170,823 | B2 | 1/2007 | Fabricius et al. | |
| 7,337,906 | B2 | 3/2008 | Chang | |
| 7,886,909 | B2 | 2/2011 | Robinson | |
| 7,891,492 | B2 | 2/2011 | Wenninger et al. | |
| 2009/0139893 | A1 | 6/2009 | McGonagle et al. | |
| 2011/0180448 | A1 | 7/2011 | Taneja et al. | |
| 2012/0097560 | A1 | 4/2012 | Contractor | |

OTHER PUBLICATIONS

Tassilo Korab, The Other Drug Problem, Pharmaceutical Manufacturing and Packing Sourcer, Spring 2007, pp. 42-43.

* cited by examiner

*Primary Examiner* — Philip R Wiest
*Assistant Examiner* — Benjamin Klein
(74) *Attorney, Agent, or Firm* — Lambert & Associates; Gary E. Lambert; David J. Connaughton, Jr.

(57) ABSTRACT

The present invention discloses an adjustable medication blister package that provides custom patient schedule of medications based on a future exam time. The adjustable medication blister package has multiple medications individually enclosed in blister packs where each blister pack is indicated with correct time to take each medication. A timing indicator which is populated with times is placed behind a base card where individual correct times can be seen through indicator apertures once a user selects the time of the future event using an adjustable time selector.

13 Claims, 5 Drawing Sheets

MEDICATION DISPENSING BLISTER CARD PACKAGE WITH ADJUSTABLE MECHANISM THAT PROVIDES A CUSTOM PATIENT SCHEDULE FOR COMPLEX MEDICATION REGIMENS

DESCRIPTION OF THE INVENTION

1. Field of the Invention

This invention relates to medication dispensing systems. More specifically, the present invention relates to systems of dispensing medication to a patient to be taken at a specific time or times based on a time of a future event.

2. Background

Premedication is an act of taking, individually or in combination, any regimen of medicine such as drugs, medication, nutrition supplements, vitamins, and the like, in advance of a future event. The future event can be any medical procedure for diagnostic or treatment purposes, for example, a radiologic study, chemotherapy infusion, or surgery that is scheduled for some time in the future. The premedication is prescribed for various reasons including, but not limited to, alleviating discomfort, aiding a diagnostic or therapeutic procedure, and preventing life threatening adverse reactions or consequences that may arise during the future event.

Premedication regimens often require the administration of multiple drugs at varying dosages and varying times dependent on the time of the future event. Further, the regimen often includes a mix of prescription medication and over the counter medications or any nutrition or vitamin supplements. Moreover, the regimen often includes instructions to take dosages during inconvenient or confusing times (e.g., 3 AM or 7 hours before the future event). The dosage times of the regimen may change if the future event time changes, as medical and other appointment sometimes do. Consequently, patients often mismanage dosing schedules, even despite clear instructions, both verbal and written, from the prescribing physicians and pharmacists.

The complex issue of patient medication non-compliance is well established. The complexity of premedication regimens and their dependence on the time of a future event results in high rates of non-compliance, both intentional and unintentional.

Previous devices may address compliance of patients on multiple long term medications with the ability to store many pills or tablets in a storage device combined with daily reminders or alarms. While these advances are helpful they do not addresses poor compliance of short duration, complex premedication schedules, such as those described below, in which timing related to a future event, is critical.

Therefore, what is needed is a medication dispensing device that instructs a user of proper timing for the taking of the medicine. Further, what is needed is a device that may adjust the proper timing based on the time of a future event.

SUMMARY OF THE INVENTION

Embodiments of the present invention are directed to medical devices for dispensing medication that obviate one or more of the limitations and disadvantages of prior medical devices. The following clinical examples are provided to demonstrate the clinical utility, but are not meant to limit the scope of the claimed invention.

EXAMPLE ONE

Intravenous Contrast for Medical Imaging

Intravenous (IV) contrast is used more than 10 million times each year in the United States for radiological studies.

Such studies include CT scans, MRI's, cardiac or conventional angiograms, and IV pyelograms. Allergic type reactions are relatively common, occurring in 5 to 8% of people receiving IV contrast with an estimated 800,000 reactions per year in the US. Such reactions can be as mild as a rash and others severe, leading to death. Some patients that have allergic reactions require additional or subsequent imaging with IV contrast. In this case, pre medication would be prescribed to prevent a future adverse reaction. The American College of Radiology recommends patients at risk for IV contrast reactions are premedicated according to the following schedule:

Prednisone 50 mg orally 13 hours, 7 hours, and 1 hour prior to the imaging study;

And

Diphenhydramine 50 mg orally 1 hour prior to the imaging study

The effectiveness of this premedication regimen depends on precise timing, both with respect to the individual components, and with regard to the subsequent exam. Conventionally, patients are given written instructions as described above. They are then directed to schedule the future imaging study or the "Exam Time". Patients must then perform the subtraction from the Exam Time to the times of the recommended doses (i.e. 13 hours, 7 hours and 1 hour prior to exam). When patients are given their Exam Time (e.g., 11:00 AM), many have difficulty calculating the times to take the medications (in this example 10:00 PM the night before, 4:00 AM and 10:00 AM the day of the exam).

The complexity of the task often leads to patient inconvenience and/or stress, patient errors, and patient noncompliance, all of which can interfere with the purpose of the medication, such as, for example, to prevent allergic reactions from occurring.

EXAMPLE TWO

Chemotherapy

Patients receiving chemotherapy often receive a premedication regimen to prevent infusion related side effects. A typical regimen prescribed prior to the administration of chemotherapy agents (e.g., paclitaxel, a common chemotherapy used in breast, lung and ovarian cancer) includes:

Dexamethasone 20 mg orally 12 and 6 hours before infusion;

And

Diphenhydramine 50 mg orally 1 hour prior to infusion;

And

Cimetidine 300 mg or Ranitidine 50 mg orally 1 hour before infusion

As in Example One, the complexity of the above examples often leads to poor compliance and subsequent decreased effectiveness of the treatment. The patient's inability to properly follow the regimen can cause the patient to unnecessarily suffer during and after the chemotherapy treatment.

The present medication package may comprise a base having a medicine storage portion preloaded with the prescribed premedication regimen and a device configured for displaying an adjustable medication schedule to the patient. After opening the package, the patient uses an adjuster such as a slide, wheel mechanism, digital adjuster, and the like, to adjust a timing indicator to select the time for the future event (e.g., the medical procedure, radiologic study, chemotherapy infusion or surgery). The adjustment is complete when the time of the future event is shown in an event time display of the base. Selection of the time for the future event will display the schedule for the components of the premedication regimen in one or a plurality of administration time displays.

Accordingly, the advantages of the embodiments disclosed herein will reduce errors in calculating times for taking the components of a complex premedication regimen. As a result, confusion with instructions may be greatly reduced or eliminated. In addition, the combination of over-the-counter medications and prescription medications may be simplified by their combination in a single medicine storage portion. The packing may eliminate multiple prescription bottles for premedication regimens involving multiple drugs. All of these advantages have clear benefits for all parties involved, including the prescribing physician, the pharmacist and the patient.

Further advantages of the present invention may include improvements in patient compliance, patient satisfaction and patient safety when patients adhere to the recommended premedication regimen. The disclosed embodiments may reduce errors in calculating dosage times, most commonly performed by the patient. If the physician or pharmacist had calculated the exact times of the premedication regimen, which is also subject to error, changes in the future event times could not be easily adjusted for. If, for example, the time of a patient's exam was changed, the patient could easily use the adjuster to adjust the dose schedule appropriately.

Additional objects and advantages of the invention will be set forth in part in the description which follows, and in part will be obvious from the description, or may be learned by practice of the disclosed embodiments. The objects and advantages of the disclosed embodiments will be realized and attained by means of the elements and combinations particularly pointed out in the appended claims.

It is to be understood that both the foregoing general description and the following detailed description are exemplary and explanatory only and are not restrictive of the disclosed embodiment, as claimed.

DETAILED DESCRIPTION

The accompanying drawings, which are incorporated in and constitute a part of this specification, illustrate several embodiments of the invention and together with the description, serve to explain the principles of the invention. The drawings use a particular premedication regiment as an example, but the scope of the present invention is not limited to this single example.

Generally, the present invention contemplates a medication package. The medication package may comprise a base. The base may comprise a medicine storage portion, configured to store a medicine within it. Further, the base may comprise an event time display region configured to display a future event time, such as the time of a medical examination or doctor's appointment. The base may also comprise an administration time display region configured to display a time for the administration of the medicine within the medicine storage portion. The time displayed in the administration time display region will be the appropriate time for medicine administration based on the time of the future event. A timing indicator may be attached to the base. The timing indicator having an adjuster, and a plurality of times displayed on its outer surface. The plurality of times may be displayed on the outer surface in any way such as by printing times on the surface, or in an embodiment wherein the timing indicator is digital, displaying a time on an electronic display. One of the plurality of times on the outer surface is displayable in the event time display region, while another time is displayable in the administration time display region. Upon adjustment of the time displayed in the event time display region using the adjuster, the administration time display region automatically adjusts to show a proper medicine administration time based on the event time. It should be understood that the term displayed and shown refer to any mode of making a time visible in a particular region to notify a user.

The medication package and components therein may be constructed of any material suitable for personal medical storage. For example, materials of which the medication package and components may be made include cardboard, plastic, metal, composite materials, and the like. In one embodiment, the package material may be sterilizable in an autoclave. Moreover, the medication package and components may be made of varying materials. For example, the base may be constructed of a cardboard material, while the medicine storage portion and timing indicator may be constructed of a plastic.

Figure 1:
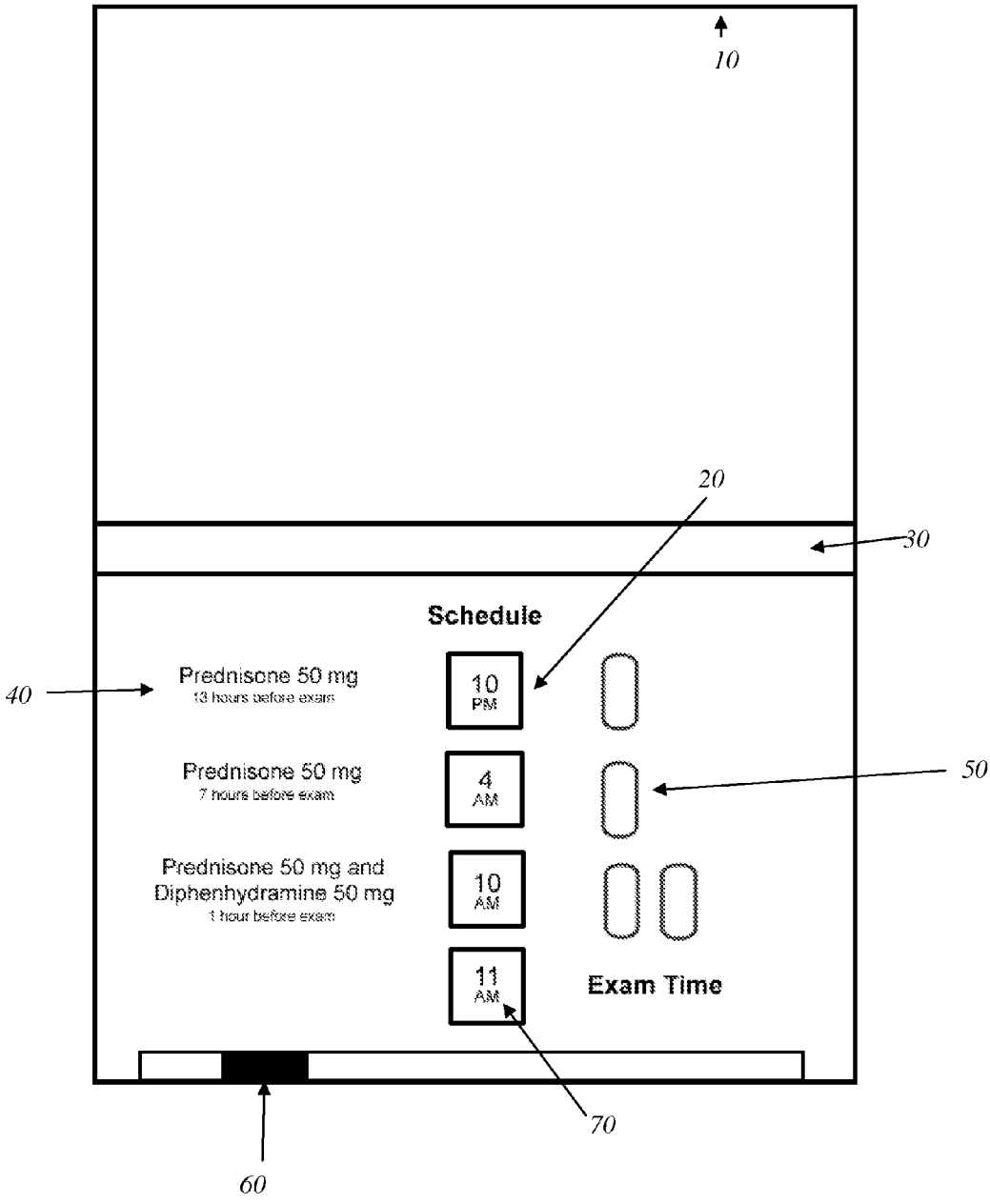
FIG. 1 provides an elevation view of one embodiment of a medication package.

FIG. 1 shows a medication package having a base formed as a card 10. The base card 10 has a medication loaded in a medicine storage portion of the base, shown as a blister pack 50. The medication in the blister pack 50 can be accessed by applying pressure to the medication. The blister pack 50 is formed as a cavity forming a protrusion, with a piece of foil or other film covering the cavity. When pressure is applied, the medication will be expelled on a rear of the base card 10, where there are perforations allowing release of the medicine. Each medication has a label 40 identifying the medication. An event time display 70 is shown in this embodiment as an aperture formed in the base card 10, and is positioned at a lower portion of the base card 10. A future event, in this case "Exam Time" is used to set the times for medicine administration, because the premedication schedule is dependent on the time of this event. Further, each medication is adjacent to an administration time display, here formed as an aperture 20 in the base card 10. The administration time display 20 shows the time that the medication is to be taken. The times of the administration time display 20 are manipulated by moving an adjuster 60 which moves a rectangular timing indicator card 80 (FIG. 4) or circular timing indicator card 100 (FIG. 5) with preprinted times 90. In the embodiment shown, the timing indicator is formed as a card disposed on a rear of the base card 10. The base card 10 may have a top portion and a bottom portion, such that the base card 10 may have a fold 30 in the middle which allows for the package to be folded in half.

Figure 2:
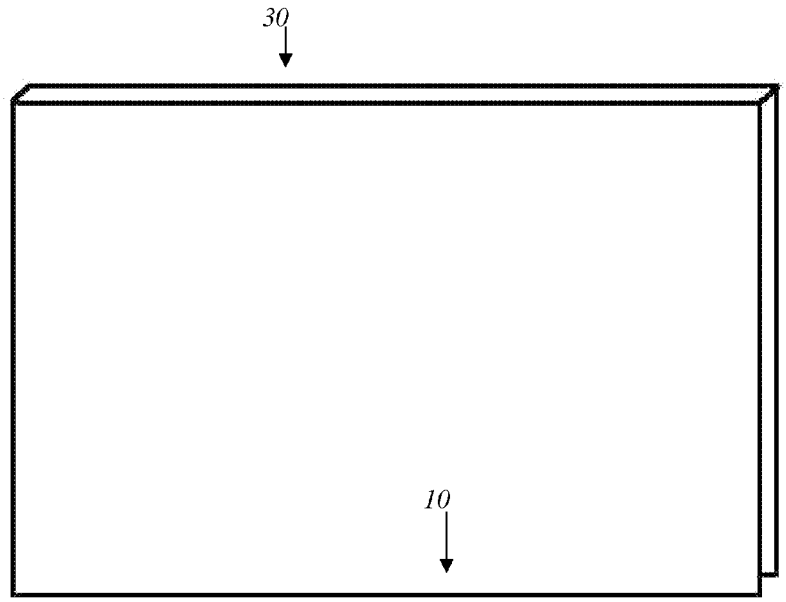
FIG. 2 provides a view of another embodiment of the medication package having a cover in a closed position.

FIG. 2 shows a front of an embodiment of the medication package with a closed cover. A base card 10 of the medication package may measure approximately 3×5×0.5 in (H×L×W) in the closed position, 6.5×5×0.5 in (H×L×W) in the open position. A front of the medication package may have printed material, such as product name, logo, information and instructions. A back of the package may also contain printed material including product name, logo, information and instructions. The back of the package may have pre-cut perforations (not shown) for the dispensing of medication loaded in a blister, allowing passage through a rear of the base card 10. The card 10 is folded over at a fold 30.

Figure 3:
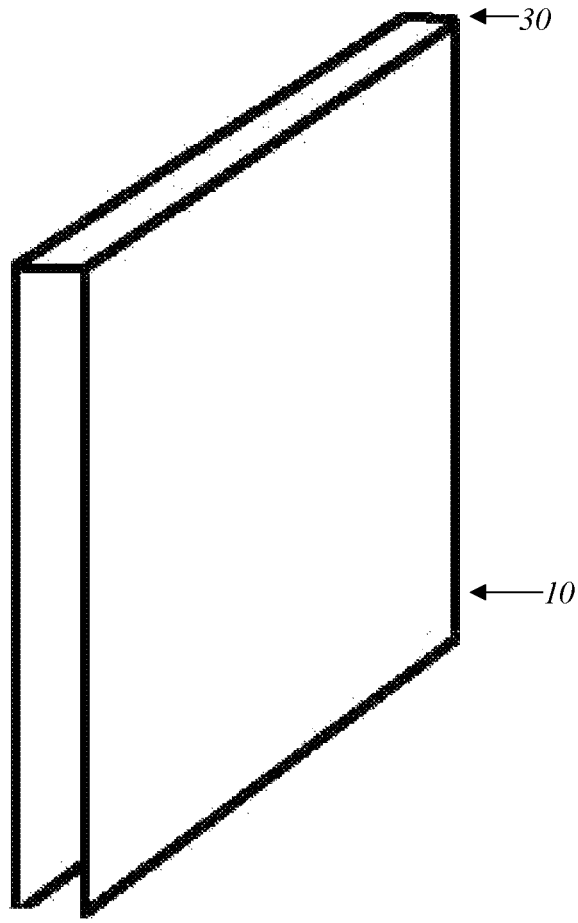
FIG. 3 provides a profile view of an embodiment of the medication package having a cover in a closed position.

FIG. 3 shows a profile view of the closed medication package an interior portion of the base card 10 can be seen. The card 10 is folded over at a fold 30.

Figure 4:
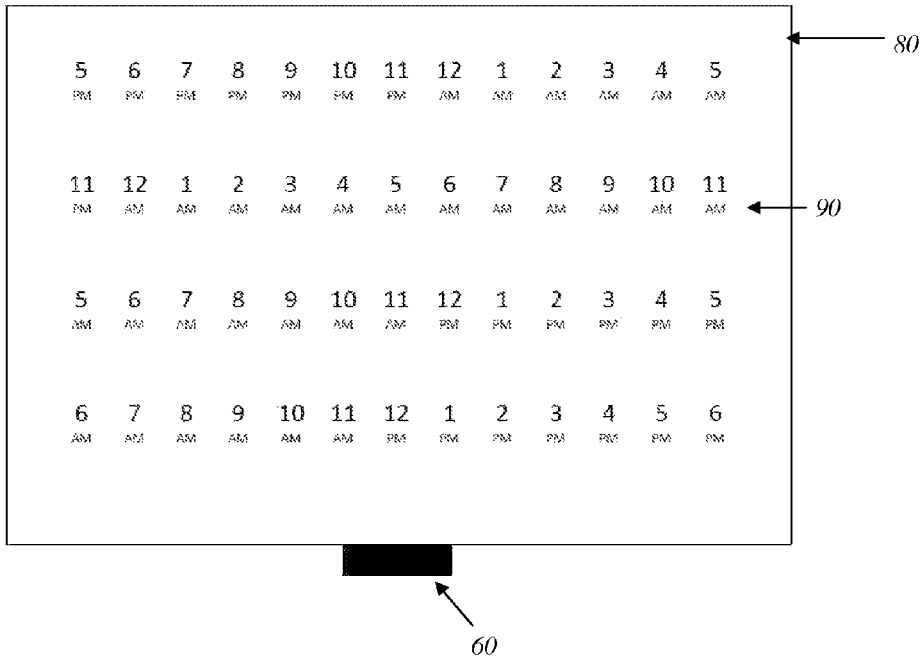
FIG. 4 provides an elevation view of an embodiment of a timing indicator formed as a rectangular card.

FIG. 4 shows a timing indicator formed as a rectangular card 80. When attached to the base card 10, the rectangular timing indicator card 80 is not entirely visible to patients. In operation, the components of the rectangular timing indicator card 80 that are visible are the vertically arranged times 90 that are displayed in the administration time display 20 and event time display 70. An adjuster 60 may also be visible and accessible to the patient. The adjuster 60 may control which vertically arranged times 90 are displayed. The adjuster 60 is configured as a slider, and thus sliding the adjuster 60 laterally along the base card 10 allows display of varying times in the event time display 70 and administration time display 20. In this embodiment, the vertically arranged times 90 are arranged in one hour increments and are specific to the premedication regimen. In one embodiment, a rectangular timing indicator card 80 may be attached to the base card 10 to allow lateral sliding of the rectangular timing indicator card 80. Further, the rectangular timing indicator card 80 may be removable from the base card 10.

Figure 5:
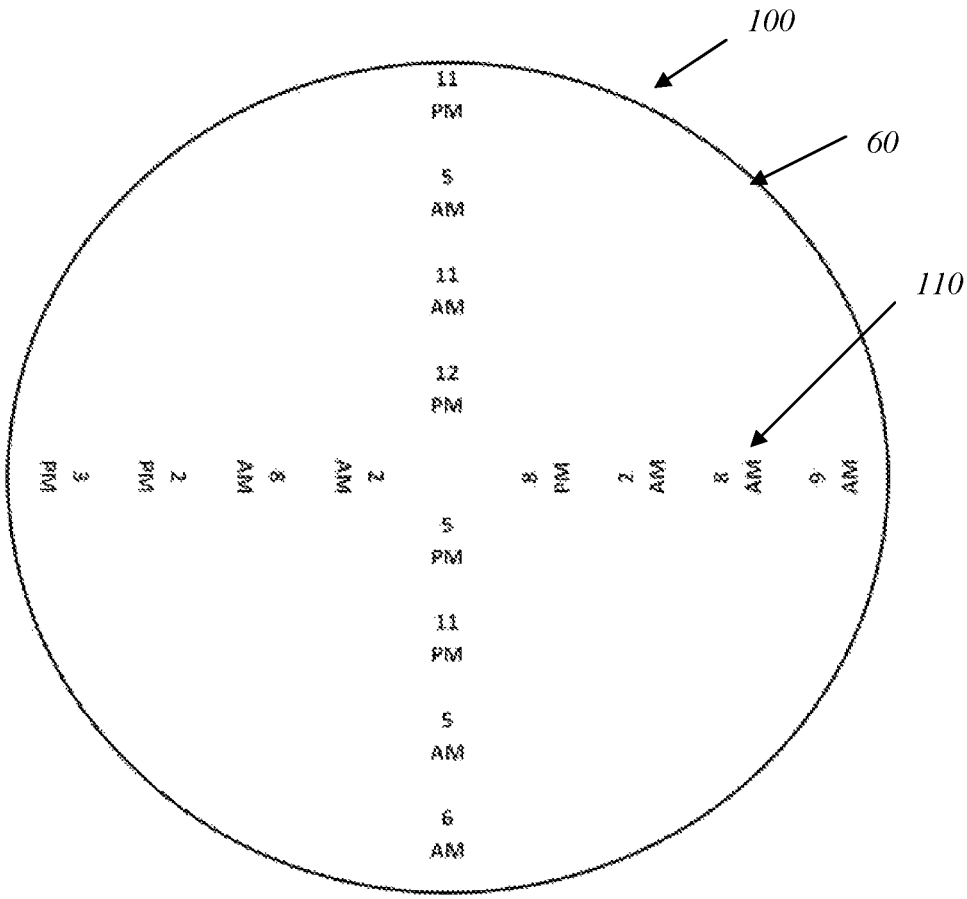
FIG. 5 provides an elevation view of an embodiment of a timing indicator formed as a circular card.

FIG. 5 shows a timing indicator formed as a circular card 100. The circular timing indicator card 100 is not entirely visible to patients when attached to the base card 10. The components of the circular timing indicator card 100 that are visible are the radially arranged times 110 that are displayed in the administration time display 20 and event time display 70, and the adjuster 60, which controls which radially arranged times 110 are displayed. By rotating the circular timing indicator card 100 via the adjuster 60, the user controls which radially arranged times 110 are displayed. In this embodiment, the radially arranged times 110 are displayed in one hour increments and are specific to the premedication regimen. Further, the circular timing indicator card 100 may be removable from the base card 10.

In one embodiment of operation, the patient may receive a medication package. In some embodiments, the package will be in a closed position similar to FIG. 2. The patient will open the medication package or otherwise access the elements of the package such as those shown in FIG. 1. Upon unfolding the medication package, the patient will first select the time display 70 of the future event using an adjuster 60 to manipulate a rectangular timing indicator card 80 or circular timing indicator card 100. An example of a future event time display is element 70, marked with "Exam Time" in FIG. 1. The event time display, shown in this figure as an aperture 70 will be adjusted to display a time of a known future event by using an adjuster 60 to align the "Exam Time" with the aperture 70 on the card next to text "Exam Time". By selecting the "Exam Time" the remaining administration time displays 20 will show the times that the medications are to be taken. Selection of the future event may create a custom, adjustable schedule for the patient based on the future event, in compliance with the recommended schedule.

In this embodiment, upon arrival of the first scheduled time in the administration time display, the patient may dispense the first component of the premedication regimen by applying pressure on the medication in the blister pack. The medication may be expelled through the back of the card, aided by pre-cut perforations in the shape of the pill or tablet. Patient will continue to dispense components of the premedication regimen until completed or reaching the time of the future event. The empty packaging can be discarded upon completion of all of the components, or may be re-used or recycled.

An adjuster, such as a slide tab, rotating wheel, digital mechanism or the like is connected to the rectangular timing indicator card, circular timing indicator card or the like. The adjuster is used to select the time of the future event by adjusting the timing indicator to show the event time in the event time display. Based on this adjustment, administration time displays on the base will show appropriate times for administration of various medicines stored in the base.

In addition, at least certain aspects of the aforementioned embodiments may be combined with other aspects of the embodiments, or removed, without departing from the scope of the invention.

There are various possibilities with regards to the adjuster and timing indicator, two examples are provided in FIG. 4 and FIG. 5 utilizing a slide mechanism and a wheel mechanism respectively. One additional possibility is a digital mechanism whereby the exam time is entered digitally and the digital display shows the times each medication is to be taken.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A medication package comprising:

a base, the base comprising a plurality of medicine storage portions, a first display region, a second display region, and a third display region, each of the plurality of medicine storage portions forming a cavity, a medicine being disposed within the cavities of the medicine storage portion;

a timing indicator attached to the base, the timing indicator comprising an adjuster, and a plurality of times displayed on an outer surface, the plurality of times comprising a plurality of future event times, a plurality of first administration times, a plurality of second administration times wherein each of the plurality of first administration times being placed in alignment with each of the plurality of future event times at a first interval, a plurality of second administration times being placed in alignment with each of the plurality of future event times at a second interval different from the first interval;

the first display region of the base configured to show one of the plurality of future event times, the one of the plurality of future event times displayed on the timing indicator being displayed in the first display region, one of the plurality of times shown in the first display region being adjustable by the adjuster of the timing indicator;

the second display region of the base configured to show one of the plurality of first administration times, the one of the plurality of first administration times displayed on the timing indicator being displayed in the second display region;

the third display region of the base configured to show one of the plurality of second administration times, the one of the plurality of second administration times displayed on the timing indicator being displayed in the second display region; and wherein the plurality of times displayed on the timing indicator being arranged such that when one of the plurality of future event times is shown on the first display region, one of the plurality of first administration times corresponding to the one of the plurality of future event times is shown on the second display region, one of the plurality of second administration times corresponding to the one of the plurality of future event times is shown on the third display region, the second display region instructing a user of the correct time to administer a first medication in anticipation of a future event, the future event being at the time on the first display region, the third display region instructing the user of the correct time to administer a second medication in anticipation of the future event, the future event being at the time on the first display region.

2. The medication package of claim 1 wherein each of the plurality of medicine storage portions comprises a blister pack, the blister pack comprising a protrusion forming a cavity and a film disposed across a rear of the cavity.

3. The medication package of claim 1 wherein the first display region, the second display region, and the third display region are each apertures formed by the base, and wherein the timing indicator is mounted to a rear of the base, each of the apertures allowing a viewing of one of the plurality of times displayed on the timing indicator.

4. The medication package of claim 1 wherein the timing indicator is a rectangular card, the rectangular card being laterally slideable along a rear of the base.

5. The medication package of claim 1 wherein the timing indicator is a circular card, and rotatably slideable about a center point, the timing indicator being attached to a rear of the base.

6. The medication package of claim 1 wherein the timing indicator is removably attached to the base, the timing indicator being replaceable.

7. The medication package of claim 1 further comprising a cover for the base, the cover being attached to the base, the cover allowing access to each of the plurality of medicine storage portions in an open position, and preventing access to each of the plurality of medicine storage portions in a closed position.

8. A medication package comprising:

a base card forming an interior portion, and forming a plurality of medicine storage portions;

each of the plurality of medicine storage portions forming a cavity, a medicine being disposed within at least on of the plurality of cavities;

a timing card disposed within the interior portion of the base card, a slide mechanism attached to the timing card and being accessible from an outside of the base card, the timing card having a plurality of times marked on its surface, the plurality of times comprising a plurality of future event times, a plurality of first administration times, a plurality of second administration times wherein each of the plurality of first administration times being placed in alignment with each of the plurality of future event times at a first interval, a plurality of second administration times being placed in alignment with each of the plurality of future event times at a second interval different from the first interval;

a future event time aperture formed by the base card;

a first administration time aperture formed by the base card;

a second administration time aperture formed by the base card; and an orientation of the timing card being adjustable via the slide mechanism, such that when one of the plurality of future event times marked on the timing card is aligned with the future event time aperture, one of the plurality of first and second administration times are aligned with the first and second administration time apertures, the one of the first and second administration times serving to instruct a user of correct times to take first and second medications in anticipation of a future event occurring at the time shown in the future event time aperture.

9. The medication package of claim 8 wherein each of the plurality of medicine storage portions comprises a blister pack, the blister pack comprising a protrusion forming a cavity and a film disposed across a rear of the cavity, the base card comprising a plurality of blister packs.

10. The medication package of claim 8 wherein the timing card is a rectangular card, the rectangular card being laterally slideable within the interior portion of the base card.

11. The medication package of claim 8 wherein the timing card is a circular card, the circular card being rotatable about a center point within the interior portion.

12. The medication package of claim 8 wherein the timing card is removably attached to the base card.

13. The medication package of claim 8 wherein the base card comprises a top portion and a bottom portion, the bottom portion forming the interior portion, the first administration time aperture, the second administration time aperture, and the future event time aperture, the top portion being foldable over the bottom portion.

* * * * *